US005943709A

United States Patent [19]

Chiu

[11] Patent Number: 5,943,709

[45] Date of Patent: Aug. 31, 1999

[54] SWIMMING POOL ASSEMBLY

[76] Inventor: Hsin-Yuan Chiu, P.O. Box 82-144, Taipei, Taiwan

[21] Appl. No.: 09/123,398

[22] Filed: Jul. 28, 1998

[51] Int. Cl.[6] ..... E04H 4/00

[52] U.S. Cl. ..... 4/506; 4/498

[58] Field of Search ..... 4/507, 506, 488, 4/496, 498, 503, 513; 52/245, 247; 220/4.16, 4.12

[56] References Cited

U.S. PATENT DOCUMENTS

| | | | |
|---|---|---|---|
| 4,356,933 | 11/1982 | Connolly | 4/506 |
| 5,155,872 | 10/1992 | Aymes | 4/506 |
| 5,592,702 | 1/1997 | Gillebaard, Jr. | 4/506 |
| 5,640,811 | 6/1997 | Boyle et al. | 4/498 |
| 5,706,531 | 1/1998 | Aubertine | 4/498 |

*Primary Examiner*—David J. Walczak
*Attorney, Agent, or Firm*—A & J

[57] ABSTRACT

A swimming pool assembly includes a plurality of connectors, a plurality of struts, and a plurality of horizontal poles of a rhombic cross-section. After connecting the horizontal poles to engagement slots of the connectors, the structural strength of the swimming pool assembly can be considerably increased. Spring retaining pin elements are disposed inside the horizontal poles at both ends to engage positioning poles of the connectors so as to achieve firm connection. The connectors are further provided with canopy pole insert holes for mounting a canopy framework. The canopy framework can be formed by utilizing a plurality of canopy poles, a connecting tube seat, and a canopy. A sprinkling structure including L-shaped bent pipes disposed inside the engagement slots of the connectors can further be installed on the swimming pool framework.

4 Claims, 6 Drawing Sheets

SWIMMING POOL ASSEMBLY

BACKGROUND OF THE INVENTION (a) Field of the Invention

The present invention relates to a swimming pool assembly, and more particularly to a swimming pool assembly that can be quickly and easily assembled and dismantled.

(b) Description of the Prior Art

FIG. 1 shows a conventional detachable swimming pool assembly. Struts are connected to lower portions of connectors. Horizontal poles are inserted into engagement slots of the connectors in a horizontal direction. Pins are used to pass through the engagement slots and pin holes on the horizontal poles to secure them together. A swimming pool framework is thus formed, and a plastic canvas sheet is then spread over the swimming pool framework. Water can then be poured into the swimming pool framework to constitute a swimming pool assembly. However, such detachable swimming pool assemblies have disadvantages. 1. Since the horizontal poles are inserted horizontally into the engagement slots, the structural strength of the swimming pool assembly is not satisfactory, and the horizontal poles cannot bear a great load. When such a structure is applied in constructing a large swimming pool, the pool may easily collapse. 2. As the horizontal poles are secured in the engagement slots by pins, the user has to align the pin holes of the horizontal poles with those on the engagement slots using his/her naked eyes. Assembly is therefore slow. Besides, the pins may slip out, which may result in dismantling of the swimming pool assembly. 3. As the pins independent parts and are exposed on the outside, they can be easily misplaced or lost.

SUMMARY OF THE INVENTION

A primary object of the present invention is to provide a swimming pool assembly that can be assembled or dismantled quickly and easily, that has good structural strength and can bear a greater load, and that is equipped with a canopy and a sprinkling system.

According to the present invention, a swimming pool assembly includes a plurality of connectors, a plurality of struts, and a plurality of horizontal poles of a rhombic cross-section. After connecting the horizontal poles to engagement slots of the connectors, the structural strength of the swimming pool assembly can be considerably increased. Spring retaining pin elements are disposed inside the horizontal poles at both ends to engage positioning poles of the connectors so as to achieve firm connection. The connectors are further provided with canopy pole insert holes for mounting a canopy framework. The canopy framework can be formed by utilizing a plurality of canopy poles, a connecting tube seat, and a canopy. A sprinkling structure including L-shaped bent pipes disposed inside the engagement slots of the connectors can further be installed on the swimming pool framework.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
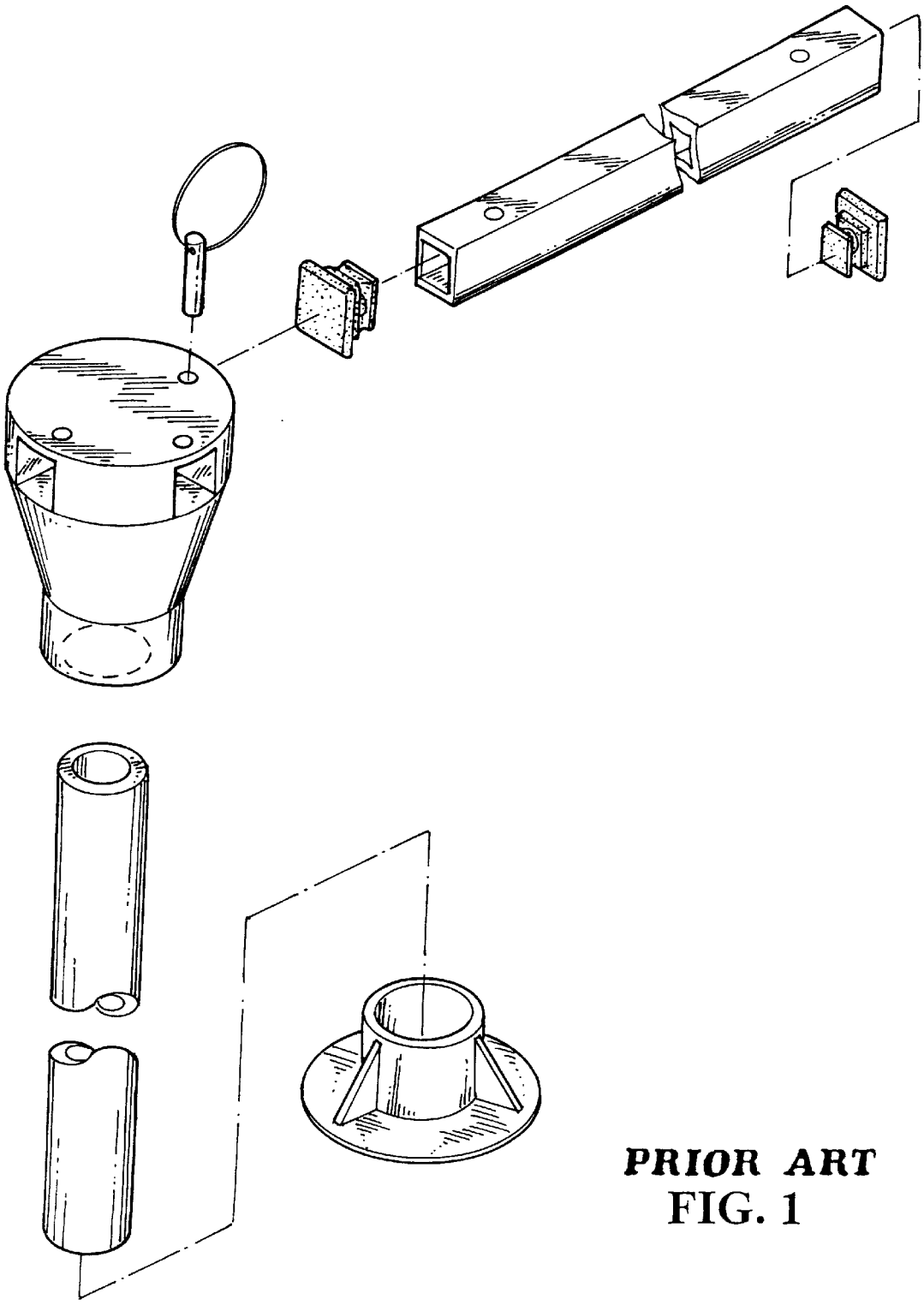
PRIOR ART FIG. 1
FIG. 1 is an exploded view of the structure of a conventional swimming pool assembly.
Figures 2, 2A:
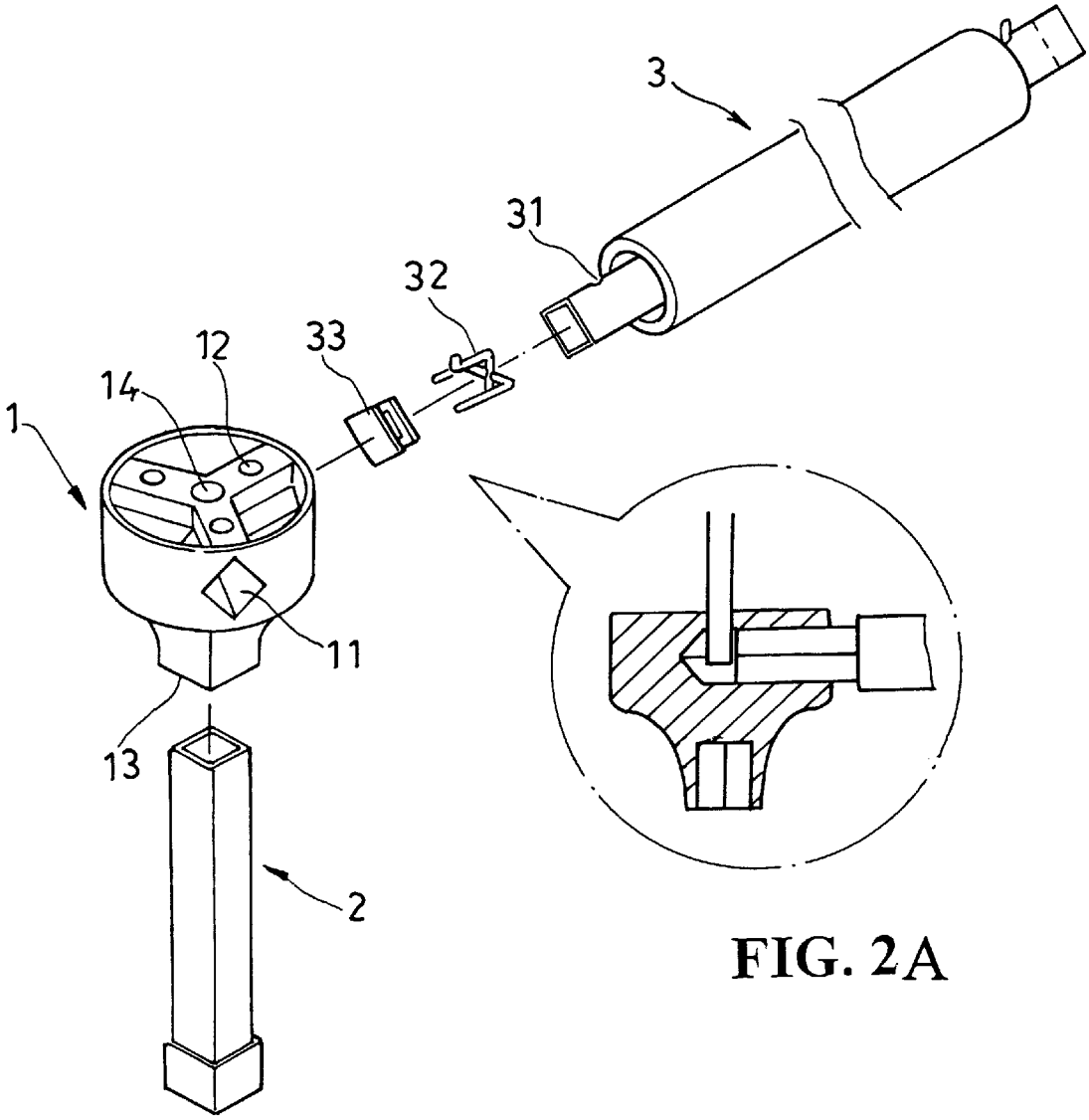
FIG. 2 is a perspective exploded view of the swimming pool assembly according to the present invention.
FIG. 2A is an enlarged view showing engagement of a horizontal pole to a connector according to the present invention.
Figure 3:
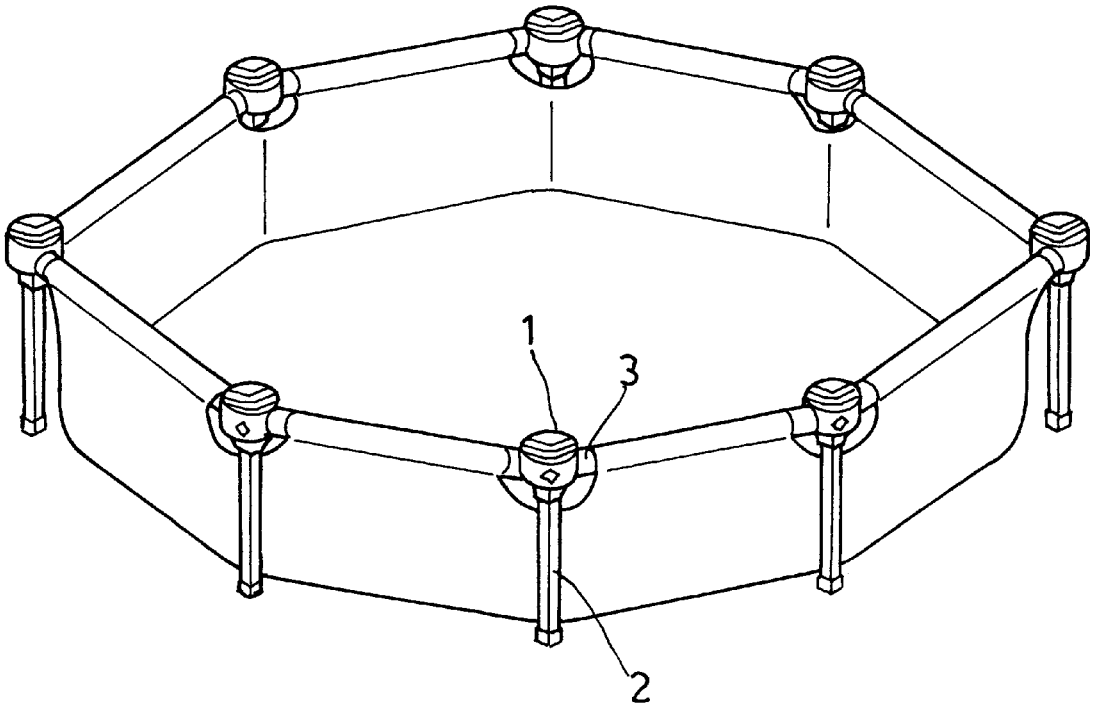
FIG. 3 is a perspective assembled view of the swimming pool assembly according to the present invention.

With reference to FIGS. 2 and 3, the present invention is comprised of connectors 1, struts 2, and horizontal poles 3 having a rhombic cross-section.

Each connector 1 is provided with inter-communicating through rhombic engagement slots 11. Each engagement slot 11 has a longitudinally oriented positioning hole 12 near its open end. The two ends of each horizontal pole 3 may just fit into the engagement slots 11 of adjacent connectors 1. The horizontal pole 3 has longitudinally oriented retaining pin holes 31 formed at both ends respectively. The retaining pin holes 31 may just align with the positioning holes 12 of the engagement slots 11. Spring retaining pin elements 32 are provided at both ends of the horizontal pole 3 such that a pin portion thereof projects from the corresponding retaining pin hole 31. When the horizontal pole 3 is connected to adjacent connectors 1, they are held in position by means of the spring retaining pin elements 32 that engage the positioning holes 12 of the engagement slots 11 of the connectors 1. Such an arrangement makes the assembly of the swimming pool assembly of the present invention quick and stable. In addition, stop caps 33 may be fitted at both ends of the horizontal pole 3 to enhance its appearance and avoid hurting users. Furthermore, the connector 1 is provided with a connecting hole 13 on a bottom side thereof for receiving a strut 2. A top side of the connector 1 is centrally formed with a canopy pole insert hole 14 for receiving a canopy pole 5. A swimming pool assembly framework can be constructed by using the connectors 1, struts 2, and horizontal poles 3 of the present invention. A known plastic canvas sheet can then be erected on the framework to form a swimming pool assembly. When the swimming pool assembly is filled with water, the tension of the water on the canvas sheet will enhance the strength of the entire structure according to the present invention.

Figures 4, 4A:
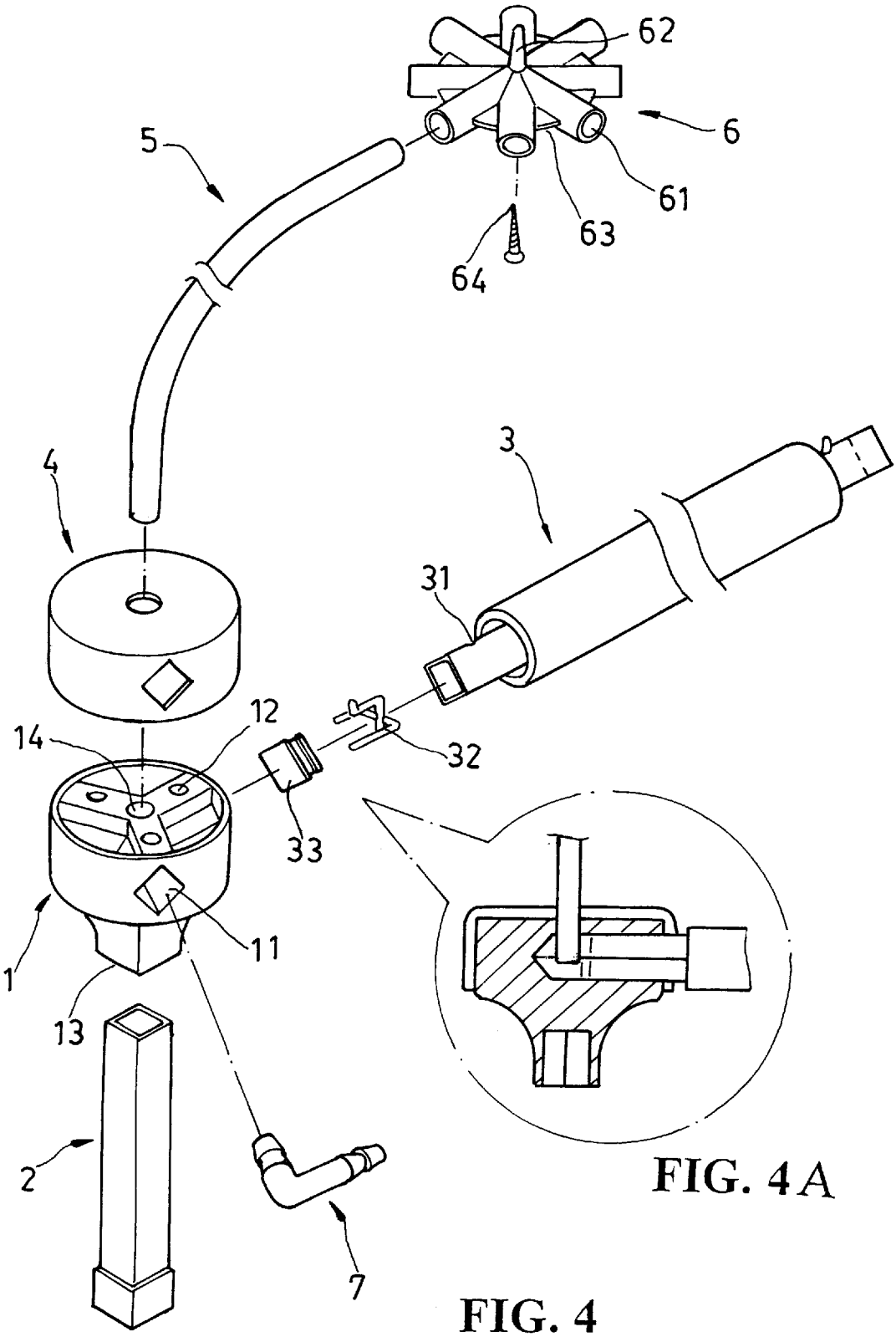
FIG. 4 is a perspective exploded view of a canopy framework according to the present invention.
FIG. 4A is an enlarged view illustrating connection of the horizontal pole to the connector according to the present invention.
Figures 5, 5A, 5B:
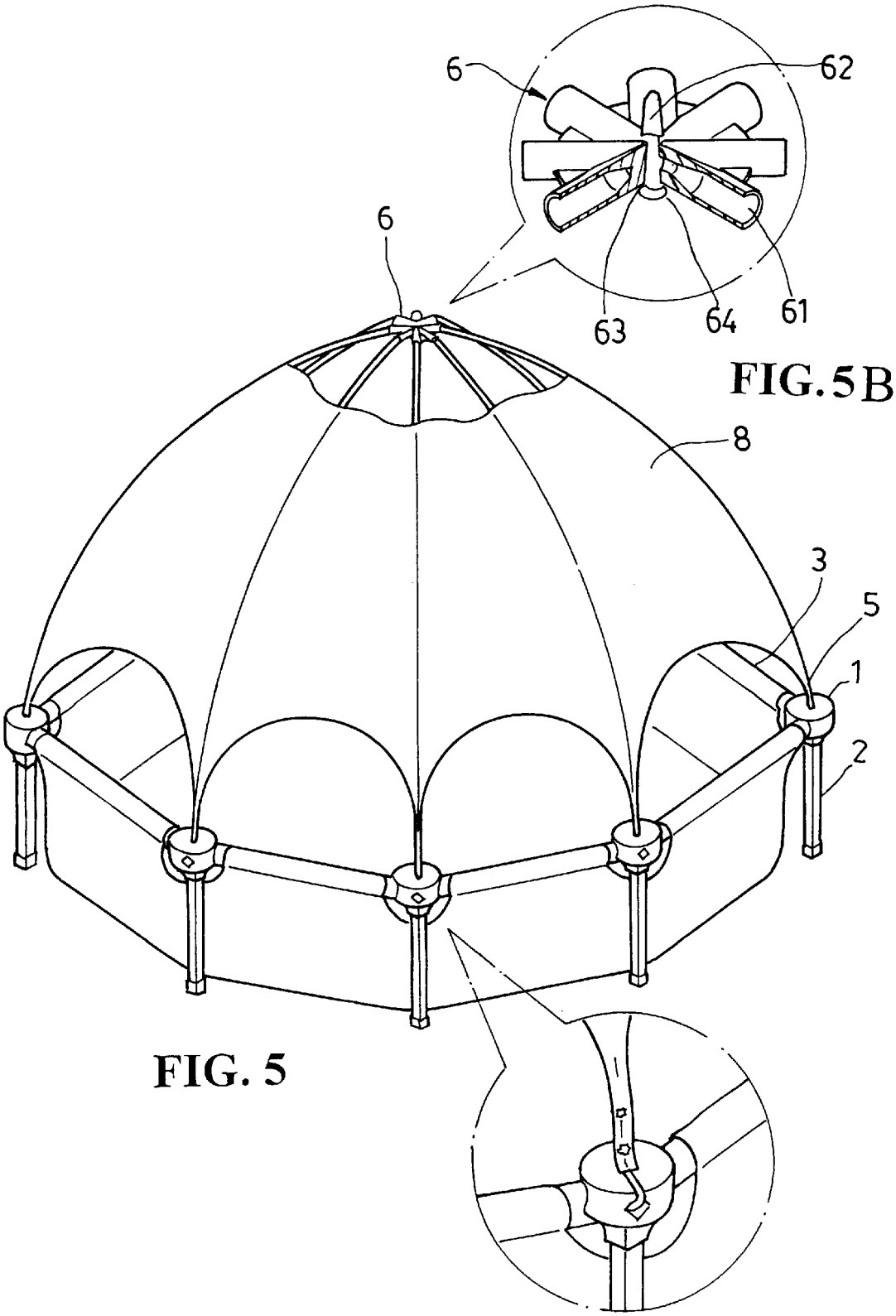
FIG. 5 is a perspective assembled view of the canopy structure of the present invention.
FIG. 5A is an enlarged view of the canopy structure.
FIG. 5B is an enlarged view of a connecting tube seat according to the present invention.

Referring to FIGS. 4 and 5, a canopy assembly having a water sprinkling system can be installed on the swimming pool assembly of the present invention. Apart from being formed with the canopy pole insert hole 14 for receiving the canopy pole 5, the connector 1 further has a connector cover 4 fitted thereon. The connector cover 4 is provided with holes at positions that correspond to the structure of the connector 1. The canopy pole 5 is a hollow tubular structure having one end inserted into the canopy pole insert hole 14 of the connector 1 with the other end inserted into a connecting tube 61 of a connecting tube seat 6 on top thereof. The connecting tube seat 6 is a disc-shape structure having eight short connecting tubes 61 that are spaced equi-angularly apart and extend outwardly from a central portion thereof. A bottom side of the connecting tube seat 6 is formed with a water outlet 63 that communicates with the connecting tubes 61. The water outlet 63 has a screw 64 lockably provided thereon, the screw being capable of controlling the water flow. Furthermore, an upper side of the connecting tube seat 6 is provided with a tapered canopy top securing bolt 62 for lockable engagement with the screw 64. A plurality of canopy poles 5 can be connected to the connecting tubes 61 of the connecting tube seat 6 at one end and inserted to the canopy pole insert holes 14 of the connectors 1 at the other, thereby forming a canopy framework. A canopy 8 is then secured to the canopy framework thus formed to achieve a sun-shading effect.

Figure 6:
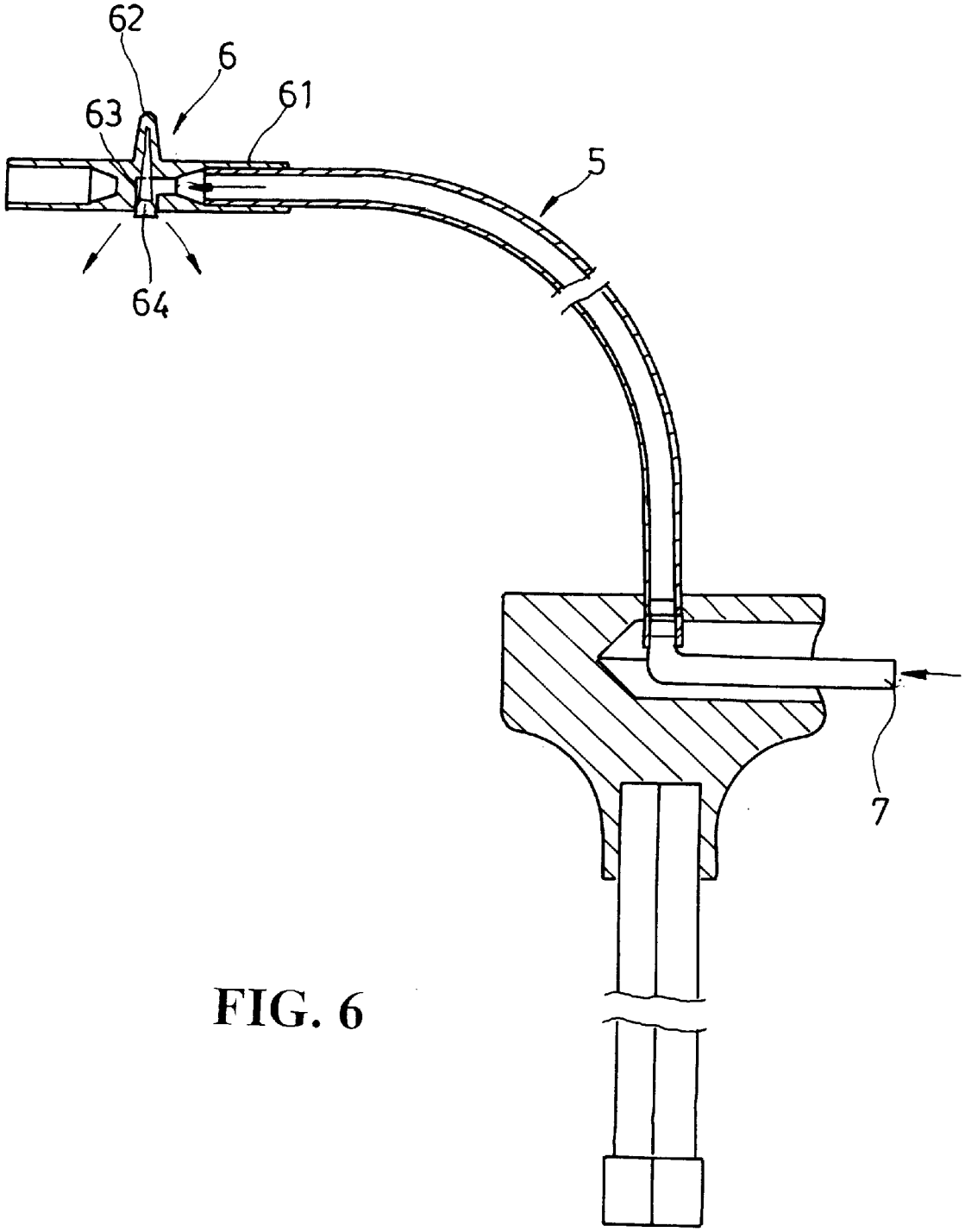
FIG. 6 is a schematic view of the sprinkling system of the present invention.

FIG. 6 shows the sprinkling system. An L-shaped bent pipe 7 is inserted into the engagement slot 11 of the connector 1. Then, one end of the bent pipe 7 is connected to a tap water pipe, with the other end connected to the canopy pole 5. The opposed end of the canopy pole 5 is connected to the connecting tube 61 communicating with the water outlet 63. By turning the screw 64, water flow can be controlled for sprinkling purposes. The canopy 8 is centrally provided with a securing seat fitted on the canopy top securing bolt 62. The canopy 8 is connected to the canopy poles 5 by adhesive tapes or strings or equivalents.

In the present invention, by inserting the horizontal poles 3 of a rhombic cross-section into corresponding engagement slots 11 of the connector 1, the horizontal poles 3 can support a greater load, and the structural strength of the swimming pool assembly of the invention can be enhanced. The spring retaining pin elements 32 having pin elements that can engage positioning holes 12 of the engagement slots 11 ensure the connection between the horizontal poles 3 and the engagement slots 11 when they are inter-connected. Assembly and dismantling of the present invention is therefore easy, quick, and safe. Furthermore, the arrangement of the bent pipes 7 having one end connected to the tap water pipe and the other connected to the canopy poles through the canopy insert holes 14 of the connectors 1 and the arrangement of the canopy poles 5 connected to the connecting tubes 61 of the connecting tube 6 achieve a swimming pool assembly with a canopy structure and a sprinkling system.

The advantageous features of the present invention are enumerated hereinafter:

1. The arrangement of horizontal poles having a rhombic cross-section and engagement slots likewise having a rhombic cross-section enables the horizontal poles to bear a greater load after being coupled to the engagement slots. The structural strength of the entire structure is also increased.

2. The spring retaining pins disposed inside the horizontal poles engage positioning holes of the engagement slots of the connectors when the horizontal poles are inserted into the engagement slots. Such an arrangement makes assembly and dismantling of the swimming pool assembly of the invention quick, stable, and safe.

3. As the spring retaining pins are disposed inside the horizontal poles, they will not be misplaced. The problem with the prior art in which parts are missing during assembly is avoided.

4. The connectors are provided with canopy pole insert holes. By further utilizing the canopy poles, the connecting tube seat, the canopy, and the bent pipes, a swimming pool assembly with a canopy and a sprinkling system can be achieved.

Although the present invention has been illustrated and described with reference to the preferred embodiment thereof, it should be understood that it is in no way limited to the details of such embodiment but is capable of numerous modifications within the scope of the appended claims.

I claim:

1. A swimming pool assembly comprises a plurality of connectors, a plurality of struts, and a plurality of horizontal poles, wherein each of said connectors is a block structure that has a connecting hole on a lower side thereof for receiving a corresponding one of said struts, each of said connectors being provided with rhombic engagement slots, said engagement slots being each provided with a positioning hole near an open end thereof, each of said connectors being centrally provided with a canopy pole insert hole;

each of said horizontal poles has two ends of a rhombic cross-section that can engage a corresponding one of said engagement slots of said connectors, the ends of said horizontal pole being provided with respective retaining pin holes along an upper corner line thereof, a spring retaining pin element being disposed in either end of said horizontal pole such that a pin portion thereof projects from a respective one of said retaining pin holes to engage said positioning hole of a corresponding one of said engagement slots when said horizontal pole is inserted into said engagement slot to thereby achieve positioning, whereby said horizontal poles can be connected to said connectors to form a swimming pool of a polygonal shape.

2. A swimming pool assembly as defined in claim 1, further comprising a plurality of canopy poles and a connecting tube seat, said canopy poles having upper ends thereof connected to said connecting tube seat and lower ends insertably received in said canopy pole insert holes of said connectors to form a canopy framework and a canopy being secured on to said canopy framework to achieve a swimming pool assembly having a canopy for sun-shading purposes.

3. A swimming pool assembly as defined in claim 2, wherein said connecting tube seat includes a plurality of connecting tubes extending radially from a central portion thereof for receiving upper ends of said canopy poles, an upper side of said connecting tube seat being provided with a projecting canopy top securing bolt, a lower side of said connecting tube being provided with a water outlet to which a screw can be locked, said water outlet communicating with a canopy pole insert hole.

4. A swimming pool assembly as defined in claim 3, wherein said canopy is centrally provided with a securing seat fitted on said canopy top securing bolt, said canopy being connected to said canopy poles by adhesive tapes or strings or the like.

* * * * *